United States Patent [19]

Moser

[11] 3,965,853

[45] June 29, 1976

[54] CONTACT FUSER ASSEMBLY

[75] Inventor: Rabin Moser, Fairport, N.Y.

[73] Assignee: Xerox Corporation, Stamford, Conn.

[22] Filed: July 22, 1974

[21] Appl. No.: 490,635

[52] U.S. Cl. ..... 118/60; 118/271; 118/409; 118/416; 427/22; 432/60; 432/228

[51] Int. Cl.[2] ..... G03G 15/20

[58] Field of Search ..... 118/60, 261, 271, 409, 118/416; 432/60, 228; 427/22

[56] References Cited

UNITED STATES PATENTS

| | | | |
|---|---|---|---|
| 2,088,472 | 7/1937 | Freedlander | 118/409 |
| 2,944,484 | 7/1960 | Bruce | 101/425 |
| 3,256,002 | 6/1966 | Hudson | 118/60 |
| 3,268,351 | 8/1966 | Van Dorn | 118/60 |
| 3,291,466 | 12/1966 | Aser et al. | 432/60 |
| 3,379,171 | 4/1968 | Cordingly et al. | 118/261 |
| 3,762,365 | 10/1973 | Herzog | 118/261 |
| 3,810,776 | 5/1974 | Banks et al. | 117/17.5 |
| 3,846,151 | 11/1974 | Roteman et al. | 118/637 |

*Primary Examiner*—Louis K. Rimrodt
*Assistant Examiner*—Douglas Salser

[57] ABSTRACT

A contact fuser assembly for use in an electrostatic reproducing apparatus including an internally heated fuser roll structure comprising a rigid or non-deformable, thermally conductive core capable of interacting with a material applied thereto in such a manner as to form a thermally-stable interfacial coating intermediate the surface of the core and a release coating also formed thereon. The interfacial coating strongly adheres to the core surface and prevents toner material from contacting the outer surface of the core. The combined coatings havve a sub-micron thickness and therefore present a minimal thermal barrier to the energy being conducted outwardly by the core. The fuser assembly is characterized by the provision of means for controlling the interaction between the core and the material.

5 Claims, 1 Drawing Figure

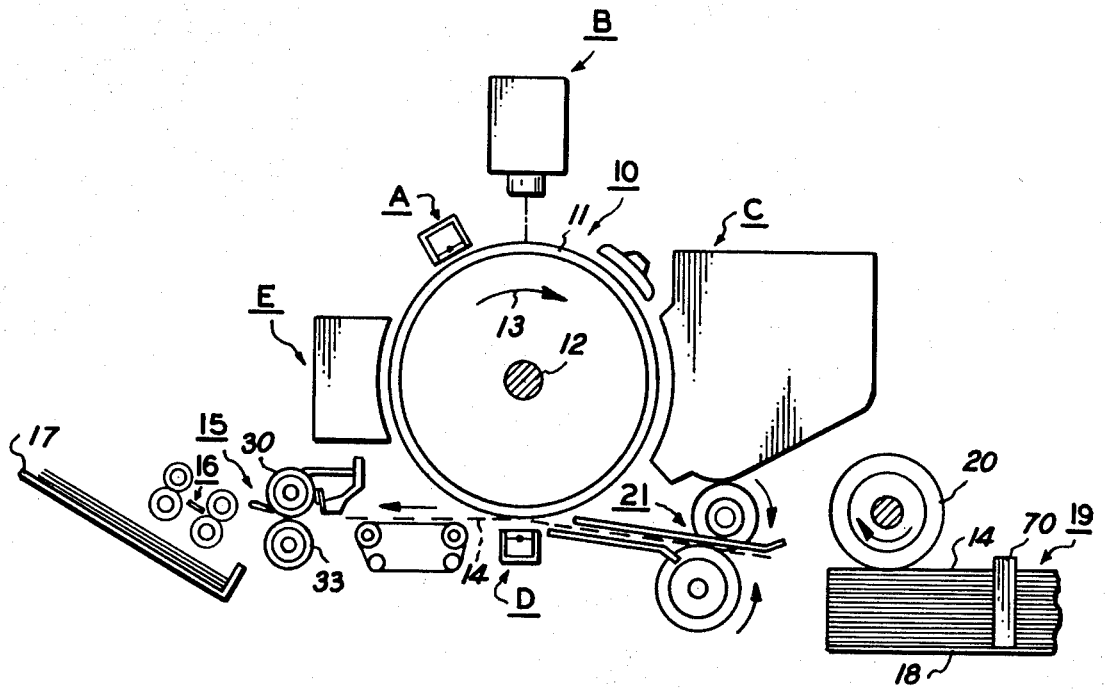
FIG. 1
FIG. 2
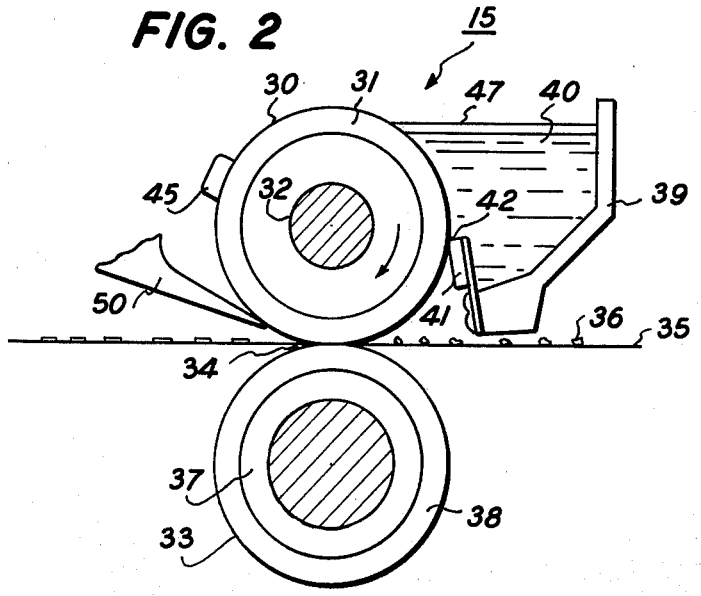
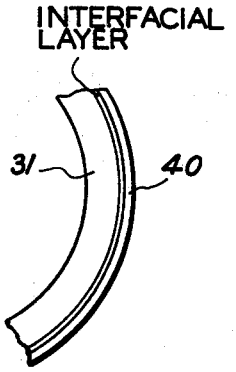
FIG. 3

CONTACT FUSER ASSEMBLY

BACKGROUND OF THE INVENTION

This invention relates generally to xerographic copying apparatus and, more particularly, to a contact fusing system for fixing electroscopic toner material to a support member.

In the process of xerography, a light image of an original to be copied is typically recorded in the form of a latent electrostatic image upon a photosensitive member with subsequent rendering of the latent image visible by the application of electroscopic marking particles, commonly referred to as toner. The visual image can be either fixed directly upon the photosensitive member or transferred from the member to a sheet of plain paper with subsequent affixing of the image thereto.

In order to permanently affix or fuse electroscopic toner material onto a support member by heat, it is necessary to elevate the temperature of the toner material to a point at which the constituents of the toner material coalesce and become tacky. This action causes the toner to be absorbed to some extent into the fibers of the support member which, in many instances, constitutes plain paper. Thereafter, as the toner material cools, solidification of the toner material occurs causing the toner material to be firmly bonded to the support member. In both the xerographic as well as the electrographic recording arts, the use of thermal energy for fixing toner images onto a support member is old and well known.

One approach to thermal fusing of electroscopic toner images onto a support has been to pass the support with the toner images thereon between a pair of opposed roller members, at least one of which is internally heated. During operation of a fusing system of this type, the support member to which the toner images are electrostatically adhered is moved through the nip formed between the rolls with the toner image contacting the fuser roll to thereby effect heating of the toner images within the nip. By controlling the heat transferred to the toner, virtually no offset of the toner particles from the copy sheet to the fuser roll is experienced under normal conditions. This is because the heat applied to the surface of the roller is insufficient to raise the temperature of the surface of the roller above the "hot offset" temperature of the toner whereat the toner particles in the image areas of the toner would liquify and cause a splitting action in the molten toner to therby result in "hot offset". Splitting occurs when cohesive forces holding the viscous toner mass together is less than the adhesive forces tending to offset it to a contacting surface such as a fuser roll.

However, toner particles will be offset to the fuser roll by an insufficient application of heat to the surface thereof (i.e. "cold" offsetting); by imperfections in the properties of the surface of the roll; or by the toner particles insufficiently adhering to the copy sheet by the electrostatic forces which normally hold them there. In such a case, toner particles may be transferred to the surface of the fuser roll with subsequent transfer to the backup roll during periods of time when no copy paper is in the nip.

Moreover, toner particles can be picked up by the fuser and/or backup roll during fusing of duplex copies or simply from the surroundings of the reproducing apparatus.

One arrangement for minimizing the problems attendant the foregoing, particularly that which is commonly referred to as "offsetting" has been to provide a fuser roll with an outer surface or covering of polytetrafluoroethylene, commonly known as Teflon, to which a release agent such as silicone oil is applied, the thickness of the Teflon being on the order of several mils and the thickness of the oil being less than 1 micron. Silicone based oils which possess a relatively low surface energy, have been found to be materials that are suitable for use in the heated fuser roll environment where Teflon constitutes the outer surface of the fuser roll. In practice, a thin layer of silicone oil is applied to the surface of the heated roll to thereby form an interface between the roll surface and the toner images carried on the support material. Thus a low surface energy layer is presented to the toner as it passes through the fuser nip and thereby prevents toner from offsetting to the fuser roll surface.

A fuser roll construction of the type described above is fabricated by applying in any suitable manner a solid layer of abhesive material to a rigid core or substrate, such as the solid Teflon outer surface or covering of the aforementioned arrangement. The resulting roll structure is subject to degradation due to the continued operation at elevated temperatures and also to damage from accidental gouging by stripper fingers conventionally employed in such systems. The foregoing in many instances necessitates replacement of the fuser roll which is quite costly when a large number of machines are involved. Moreover, the initial investment for fabricating such constructions is undesirably high and the manufacturing process is quite cumbersome.

Furthermore, since a several mil thickness of polytetrafluoroethylene along with the coating of silicone oil constitutes a poor thermal conductor, longer nip dwell and higher fuser roll temperatures are required to deliver the fusing energy required. Also, control the surface temperature of the roll presents a problem due to large temperature variations occuring before and after contacting of the substrate carrying the images.

In view of the foregoing, it would appear that the high thermal conductivity and wear resistance of bare metals or similar materials would be desirable for utilization in fuser roll structures, however, such materials have, heretofore, not been found satisfactory for such application. The latter is attributable to the very high surface energy of metals and similar materials which renders them readily wettable by hot toner materials. Once wetted by hot toner, it has been very difficult if not impossible to remove the toner from such materials while they remain hot. Commonly used release agents such as pure silicone oils have been tried in combination with various metals and other high surface energy materials but with relatively little or no success.

One approach to utilizing bare metal or other high surface energy materials has been to use low molecular weight polyethylene in conjunction with a heated fuser roll structure having a rigid core of copper. It is believed that the polyethylene chemically or otherwise reacts with the surface of the copper core to form a layer which acts as a barrier prevention toner from contacting the copper core. Polyethylene which does not react with the surface of the copper core forms a release coating on the aforementioned layer. The cohesive forces of the release layer are less than the adhesive forces between the release layer and the toner or paper. Accordingly, the paper with the toner thereon is readily stripped from the fuser roll structure.

It has been found desirable to control the degree of reactivity between the copper core and the polyethylene, particularly, during long periods of copier standby at which times it has been observed that a bead forms on the copper surface along a boundary formed by the copper, the polyethylene and the ambient air.

Accordingly, an object of this invention is to provide a new and improved copier apparatus wherein toner images are formed on a support member.

Another object of this invention is to provide in a copier apparatus, a new and improved contact fuser for fixing toner images to a support member.

BRIEF SUMMARY OF THE INVENTION

Briefly, the above-cited objects are accomplished by the provision of a contact fuser apparatus including a copper core and a deformable backup roll forming a nip with the fuser roll structure through which support sheets or members pass.

Polyethylene, which has added thereto a quantity of copper, either by mixing copper containing compounds into the polyethylene or by running the copper core in contact with the polyethylene, is metered from a sump onto the copper core of the fuser roll structure. In the presence of the heated core and the ambient air the polyethylene chemically or otherwise reacts with the copper surface to form an interfacial layer intermediate the copper surface and polyethylene which does not react with the surface of the copper core which polyethylene acts as a release coating covering the interfacial layer.

The ratio of copper to polyethylene is preferably on the order of 0.1% by weight. The foregoing has been found to satisfactorily control the beading characteristics without adversely affecting the release properties of the polyethylene.

Other objects and advantages of the present invention will become apparent when read in conjunction with the accompanying drawings wherein:

FIG. 1 is a schematic representation of a xerographic reaproducing apparatus incorporating the novel contact fuser of this invention;

FIG. 2 is a side elevational view of a fuser system incorporated in the apparatus of FIG. 1; and FIG. 3 is a fragmentary view of a fuser roll during operation.

DETAILED DESCRIPTION OF THE PREFERRED EMBODIMENT

The reproudcing machine illustrated in FIG. 1 employs an image recording drum-like member 10 the outer periphery of which is coated with a suitable photoconductive material 11. One type of photoconductive material is disclosed in U.S. Pat. No. 2,970,906 issued to Bixby in 1961. The drum 10 is suitably journaled for rotation within a machine frame (not shown) by means of a shaft 12 and rotates in the direction indicated by arrow 13, to bring the image retaining surface thereon past a plurality of xerographic processing stations. Suitable drive means (not shown) are provided to power and coordinate the motion of the various cooperating machine components whereby a faithful reproduction of the original input scene information is recorded upon a sheet of final support material such as paper or the like.

Since the practice of xerography is well known in the art, the various processing stations for producing a copy of an original are herein represented in FIG. 1 as blocks A to E. Initially, the drum moves photoconductive surface 11 through a charging station A. At charging station A an electrostatic charge is placed uniformly over the photoconductive surface 11 of the drum 10 preparatory to imaging. The charging may be provided by a corona generating device of a type described in U.S. Pat. No. 2,836,725 issued Vyverberg in 1958.

Thereafter, the drum 10 is rotated to exposure station B where the charged photoconductive surface 11 is exposed to a light image of the original input scene information, whereby the charge is selectively dissipated in the light exposed regions to record the original input scene in the form of a latent electrostatic image. A suitable exposure system may be of the type described in U.S. Pat. application, Ser. No. 259,181, filed June 2, 1972.

After exposure, drum 10 rotates the electrostatic latent image recorded on the photoconductive surface 11 to development station C, wherein a conventional developer mix is applied to the photoconductive surface 11 of the drum 10 rendering the latent image visible. A suitable development station is disclosed in U.S. Pat. application, Ser. No. 199,481 filed Nov. 17, 1971. This application describes a magnetic brush development system utilizing a magnetizable developer mix having carrier granules and toner comprising electrophotographic resin plus colorant from dyes or pigments. A developer mix is continually brought through a directional flux field to form a brush thereof. The electrostatic latent image recorded on photoconductive surface 11 is developed by bringing the brush of developer mix into contact therewith. The developed image on the photoconductive surface 11 is then brought into contact with a sheet of final support material 14 within a transfer station D and the toner image is transferred from the photoconductive surface 11 to the contacting side of the final support sheet 14. The final support material may be plain paper, gummed labels, transparencies such as Polycarbonate, Polysulfane and Mylar, etc., as desired.

After the toner image has been transferred to the sheet of final support material 14, the sheet with the image thereon is advanced to a suitable fuser assembly 15 which fuses the transfer powder image thereto. After the fusing process, the final support material 14 is advanced by a series of rolls 16 to a copy paper tray 17 for subsequent removal therefrom by a machine operator.

Although a preponderence of the toner powder is transferred to the final support material 14, invariably some residual toner remains on the photoconductive surface 11 after the transfer of the toner powder image to the final support material 14. The residual toner particles remaining on the photoconductive surface 11 after the transfer operation are removed from the drum 10 as it moves through cleaning station E. Here the residual toner particles are first brought under the influence of a cleaning corona generating device (not shown) adapted to neutralize the electrostatic charge remaining on the toner particles. The neutralized toner particles are then mechanically cleaned from the photoconductive surface 11 by conventional means as for example, the use of a resiliently biased knife blade as set forth in U.S. Pat. No. 3,660,863 issued to Gerbasi in 1972.

The sheets of final support material 14 processed in the automatic xerographic reproducing device may be stored in the machine within a removable paper cassette 18. A suitable paper cassette is set forth in U.S. Pat. application Ser. No. 208,138 filed Dec. 15, 1971.

The copier can also have the capability of accepting and processing copying sheets of varying lengths. The length of the copy sheet, of course, being dictated by the size of the original input scene information recorded on the photoconductive surface 11. To this end, the paper cassette 18 is preferably provided with an adjustable feature whereby sheets of varying length width can be conveniently accommodated therein.

In operation, the cassette 18 is filled with the stack of final support material 19 of pre-selected size and the cassette 18 is inserted into the machine by sliding along a baseplate (not shown) which guides the cassette 18 into operable relationship with a pair of feed rollers 20. When properly positioned in communication with the feed rollers 20 the top sheet of the stack 19 is separated and forwarded from the stack 19 into the transfer station D by means of registration rollers 21.

It is believed that the foregoing description is sufficient for purposes of present application to illustrate the general operation of an automatic xerographic copier which can embody the teachings of the present invention.

The fuser assembly 15 comprises heated roll structure 30 including a hollow cylinder or core 31 having a suitable heating element 32 disposed in the hollow portion thereof which is coextensive with the cylinder. The heating element 32 may comprise any suitable type heater for elevating the surface temperature of the cylinder to operational tempratures, therefore, 250°–400°F. For example, it may be a quartz lamp. The cylinder 31 is fabricated from any suitable material capable of accomplishing the objects of the present invention. Typical materials are anodized aluminum and alloys thereof, steel, stainless steel, nickel and alloys thereof, nickel plated copper, chrome plated copper, and glass. The resulting structure has an outside diameter on the order of 1.5 to 3.0 inches and has a length on the order of 10 to 15 inches. Power requirements for the foregoing are 500 to 2500 watt peak power with an average power of 300–2000 watts and 75–250 watts for standby.

The surface temperature of the fuser roll structure is controlled by contacting the surface thereof with a thermistor probe 45 as described in U.S. Pat. No. 3,327,096 issued in 1967 to Bernous and incorporated herein by reference.

The fuser assembly 15 further comprises a backup roll structure 33 which cooperates with the fuser roll structure 30 to form a nip 34 through which a copy paper or substrate 35 passes such that toner images 36 thereon contact the fuser roll structure. The backup roll structure may comprise any suitable construction, for example, a steel cylinder, but preferably comprises a rigid steel core 37 having a Viton elastomer surface or layer 38 thereon. A suitable backup roll has a core approximately 1.8 inches in diameter with a 0.1 inch cover or layer structure of Viton elastomer or other suitable high temperature elastomeric layer structure, for example, silicone rubber and a combination of Viton or silicone rubber with Teflon thereon. Viton is the trademark of Dupont Co. The specific dimensions of the members making up the backup roll will be dictated by the requirements of the particular copying apparatus wherein the fuser assembly 15 is employed, the dimensions being greater or less depending upon the process speed of the machine. The heated roll and backup roll structures are mounted on fixed axes and, therefore, are not moved in and out of engagement as fuser rolls or prior art devices.

Means (not shown) for applying a loading force in a conventional manner to the fuser assembly 15 serves to create nip pressures on the order of 15 to 150 psi average. The durometer of the backup roll is chosen such that "dwell times" of 5 to 100 miliseconds can be obtained with loading forces within the aforementioned range of pressures. "Dwell time" is proportional to the ratio of the nip length to the surface speed of the rolls. For a given angular velocity the surface speeds will vary depending upon the diameter of the rolls. For example, with a 2 inch fuser roll speed of 0 to 30 inches per second are attainable and for a 3 inch fuser rolls speeds of 0 to 45 inches per second have been attained. Accordingly, it can be seen that the aforementioned "dwell times" can be obtained by varying one or the other or both of the "dwell time" relationships. Durometers of 20–90 Shore A have been found to provide satisfactory results.

The aforementioned materials from which the fuser roll structure 30 may be fabricated are relatively high surface energy materials, consequently, hot toner material contacting such surfaces would readily wet the surface of the fuser roll. Accordingly, there is provided a sump 39 for containing a release material 40 capable of interacting with the fuser roll in accordance with objects of the present invention. The release material is preferably low molecular weight material which is solid at room temperature and which has a relatively low viscosity at the operating temperatures of the fuser roll structure. An example of such a material is polyethylene homopolymer manufactured by Allied Chemical Company and having the designation AC-8 homopolymer. A quantity of copper (i.e. 0.1% by weight) is added to the sump containing the polyethylene material in order to prevent a high degree of reactivity between the polyethylene and the core. The addition of the copper has been found to satisfactorily control the beading characteristics of that which was observed to occur with the polyethylene alone, without adversely affecting the release properties of the polyethylene.

A metering blade 41 preferably of silicone rubber is mounted to the sump 39 by conventional means such that an edge 42 thereof contacts the fuser roll structure serves to meter the release agent 40 in its liquid state onto the fuser roll. In the preferred embodiment, a blade 0.060 inch thick and having a width of 1.05 inch and length of 15 inches has been employed. By means of such a construction a 0.1–0.5 $\mu$ thickness of release agent is applied to the surface of the fuser roll. The blade 41 also aids in cleaning the fuser roll of toner.

A pair of end seals 47, preferably of sponge rubber are provided to contain the release agent in the sump 39. One or more stripper fingers 50 are provided for ensuring removal of the substrate from the fuser roll.

The toner that forms the toner images 36 is comprised of an electrophotographic resin plus colorant from dyes and pigments such as carbon black and furnace black. The developer material of which the toner forms a portion may contain cleaning materials and plasticisers in accordance with the desired formulation.

Typical toners comprise a copolymerized mixture of styrene or a blend of styrene homologs with 10 to 40% of one or more methacrylate esters selected from the group consisting of ethyl, propyl and butyl methacrylates, as described in U.S. Pat. No. 3,079,342 and incorporated herein by reference.

The effectiveness of the fuser assembly of the type herein contemplated is demonstrated by forming electrostatic latent images on the recording surfaces which are then developed by a heat fusible toner comprising carbon black pigmented copolymer, styrene n butymethacrylate, the fusibale toner particles being held on the recording surfaces in conformance with the electrostatic latent images. The toner images are thereafter transferred to plain paper. The paper having the toner images electrostatically adhered thereto is then passed at a speed of 15 inches/second between a fuser roll structure and a backup roll the former of which is heated to a temperature of 310°F. with a pressure of 140 psi being applied to the roll pair. The toner images contact the fuser roll structure which has a 2.0 inch outside diameter and is 15 inches long. The backup roll has an outside diameter of 2.0 inches with a 0.1 inch layer of silicone rubber covered with a 0.020 inch of fluorinated ethylene-propylene resin on the surface and having a durometer of 65 Shore A. The fuser roll structure is fabricated from copper having an 8 micro-inch finish. A release agent consisting of low molecular weight polyethylene designated A.C. −8 by the Allied Chemical Corporation is liquified and metered onto the copper surface prior to contacting thereof by the toner images. One hundred thousand copies are made without offsetting of toner to the fuser roll structure being observed after the final copy sheets are passed between the rolls. The fuser assembly is operated in a standby condition without bead formation on the fuser roll structure.

Another demonstration of the effectiveness of the fuser assembly of the type herein contemplated is effected by forming electrostatic images on recording surfaces which are then developed by heat fusible toner comprising carbon black pigmented copolymer, styrene-n-buthylemethacrylate, the fusible toner particles being held on the recording surface in conformance with the electrostatic latent images. The toner images are thereafter transferred to plain paper. The paper having the toner images electrostatically adhered thereto is then passed, at a speed of 4.0 inches per second, between a fuser roll structure and a backup roll, the former of which is heated to a temperature of 280°F with a pressure of 65 psi being applied to the roll pair. The toner images contact the fuser roll structure whih has a 2.0 inch outside diameter and is 10 inches long. The backup roll has an outside diameter of 2 inches with a 0.2 inch micron layer as the outer surface thereof and has a durometer of 65 Shore A. The fuser roll structure is fabricated from copper having an 8 micro-inch finish. A release agent consisting of low molecular weight polyethylene designated A. C. −8 by the Allied Chemical Corporation and having added thereto 0.1% by weight of copper is liquified and metered onto the copper surface prior to contacting thereof by the toner images. No offsetting of toner to the fuser roll structure was observed after the final copy sheets are passed between the rolls. Moreover, no bead formation on the fuser roll structure is observed.

Still another demonstration of the effectiveness of the heating system of the type herein contemplated is effected by forming electrostatic latent images on recording surfaces which were then developed by a heat fusible toner comprising carbon black pigmented copolymers, styrene-n-butylmethacrylate, the fusible toner particles being held on the recording surface in conformance with the electrostatic latent images. The toner images are thereafter transferred to plain paper. The paper having the toner images electrostatically adhered thereto are then passed, at a speed of 11 inches/second, between a fuser roll structure and a backup roll structure the former of which is heated to a temperature of 300°F. with the pressure of 96 psi being applied to the roll pair. The toner images contact the fuser roll structure which has a 2.0 inch outside diameter and is 15 inches long. The backup roll has an outside diameter of 2 inches with a 0.1 inch Viton layer on the surface and having a durometer of 65 Shore A. The fuser roll structure is fabricated from copper having an 8 micro-inch finish. A release agent consisting of low molecular weight polyethylene designated A.C. −8 by the Allied Chemical Corporation and having added thereto 0.1% by weight of copper is liquified and metered onto the copper surface prior to contacting thereof by the toner images. No offsetting of toner to the fuser roll structure was observed after the final copy sheets were passed between the rolls. Also, no bead formation in the fuser roll structure was observed.

While the invention has been described with respect to a preferred embodiment it will be apparent that certain modifications and changes can be made without departing from the spirit and scope of the invention and it is therefore intended that the foregoing disclosure be limited only by the claims appended thereto.

What is claimed is:

1. Contact fuser apparatus for fixing toner images to a support member, said apparatus comprising:

a heated fuser roll structure having a rigid, thermally conductive core;

a backup roll forming a nip with said core through which said support member moves with said toner images contacting said core; and means for forming a toner-impenetrable layer on said rigid core and a release layer on said toner impenetrable layer, said toner-impenetrable layer forming means comprising polyethylene which chemically reacts with the surface of said rigid core, said toner-impenetrable layer forming means containing copper for controlling said reactivity.

2. Apparatus according to claim 1, wherein said means for forming said release layer comprises said polyethylene.

3. Apparatus according to claim 2, wherein said rigid core comprises copper which is internally heated.

4. Apparatus according to claim 3, wherein said backup roll is deformable by said rigid core.

5. Apparatus according to claim 1, wherein the concentration of copper in said toner impenetrable layer forming means is on the order of 0.1% by weight.

* * * * *